US009748623B1

(12) United States Patent
Lee-Yow et al.

(10) Patent No.: US 9,748,623 B1
(45) Date of Patent: Aug. 29, 2017

(54) CURVED FILTER HIGH DENSITY MICROWAVE FEED NETWORK

(71) Applicants: Lee Man Lee-Yow, Longmont, CO (US); Philip Elwood Venezia, Longmont, CO (US); Jason Stewart Wrigley, Broomfield, CO (US)

(72) Inventors: Lee Man Lee-Yow, Longmont, CO (US); Philip Elwood Venezia, Longmont, CO (US); Jason Stewart Wrigley, Broomfield, CO (US)

(73) Assignee: Custom Microwave Inc., Longmont, CO (US)

( * ) Notice: Subject to any disclaimer, the term of this patent is extended or adjusted under 35 U.S.C. 154(b) by 0 days.

(21) Appl. No.: 14/788,583

(22) Filed: Jun. 30, 2015

(51) Int. Cl.
*H01P 5/12* (2006.01)
*H01P 1/213* (2006.01)
*H01P 5/19* (2006.01)

(52) U.S. Cl.
CPC ..... *H01P 1/213* (2013.01); *H01P 5/19* (2013.01)

(58) Field of Classification Search
CPC .. H01P 1/213; H01P 5/19; H01P 1/161; H01P 1/17; H01Q 13/0258
USPC ..... 333/126, 129, 134, 135, 137, 21 A, 21 R
See application file for complete search history.

(56) References Cited

U.S. PATENT DOCUMENTS 4,176,330 A * 11/1979 DiTullio ..... H01P 1/2131 333/122
4,228,410 A * 10/1980 Goudey ..... H01P 1/17 333/122
6,661,309 B2 * 12/2003 Chen ..... H01P 1/2131 333/126
6,700,548 B1 * 3/2004 Chen ..... H01Q 5/45 333/135
6,847,270 B2 * 1/2005 Yoneda ..... H01P 1/2138 333/121

* cited by examiner

*Primary Examiner* — Robert Pascal
*Assistant Examiner* — Kimberly Glenn
(74) *Attorney, Agent, or Firm* — Rick Martin; Patent Law Offices of Rick Martin, P.C.

(57) ABSTRACT

A method and apparatus forming an efficient and compact waveguide feed with all components for processing signals in multi-frequency band antenna feeds with single/dual linear/circular polarizations with/without tracking. This layout results in a very compact feed, which has excellent electrical characteristics, is mechanically robust, eliminates flange connections between components, and is very cost effective. The new layout eliminates the dummy ports and bends at least one filter element is bent to an acute angle, thereby enabling a high density packaging of the microwave feed network; and wherein a plurality of single sided corrugations are located along the bent filter element. In this design high density arrays of feeds can be realized for satellite communication.

17 Claims, 12 Drawing Sheets

CURVED FILTER HIGH DENSITY MICROWAVE FEED NETWORK

FIELD OF THE INVENTION

The present invention relates to an efficient and extremely compact layout of waveguide components for processing signals in multi-frequency band antenna feeds with single/dual linear/circular polarizations with/without tracking and providing a high density packaging array.

BACKGROUND OF THE INVENTION

Microwave signals are extremely high frequency (HF) signals, usually in the gigahertz range. They are used to transmit large amounts of video, audio, RF, telephone, and computer data over long distances. They are used in commercial and military applications, including communications to satellites, airplanes and the like. Frequencies are divided into various bands such as the S-band (2-3.5 GHz), Ku-band (10.7-18 GHz), Ka-band (18-31 GHz), and others such as the X-band etc.

Polarization is a characteristic of the electromagnetic wave. Four types of polarization are used in satellite and other transmissions: horizontal; vertical; right-hand circular (RHCP); and left-hand circular (LHCP). Horizontal and vertical polarizations are types of linear polarizations. Linear and circular polarizations are well known in the art. A wave is made up of an electric field 'E' and a magnetic field 'M'. When a wave of wavelength 'λ' is transmitted into free space from an antenna, the orientation of its electric field E with respect to the plane of the earth's surface determines the polarization of the wave. If the wave is oriented such that the E field is perpendicular to the earth, the wave is referred to as vertically polarized. If the 'E' field is parallel to the earth's surface, the wave is horizontally polarized.

FIG. 1A (prior art) is a solid rear left side perspective view of the assembly of the multi-frequency waveguide internal structure 210, an embodiment of the closest prior art from U.S. Pat. No. 7,408,427 which is incorporated herein by reference in its entirety. It has two separate frequency sections. A simplified block diagram of multi-frequency waveguide internal structure 210 is found in FIG. 1B. Multi-frequency waveguide internal structure 210 will is shown in FIG. 3A in a three sectional split block configuration. It can be seen how the prior art invention provides a compact internal structure as a waveguide feed to transmit and/or receive microwave signals. The path will be described as receiving signals into horn input/output area 207 and exiting to receiver electronics within one of the four ports described herein. Multi-frequency internal structure 210 comprises horn input/output area 207, where an input signal is received or an output signal is transmitted. An input signal passes into first common junction 208, and into LF filters 212 as polarized. The lowest frequency signal then moves through LF 90° polarizer 214. LF 90° polarizer 214 allows a 90° phase shift that is necessary for circularly polarized signals. Magic tee (hybrid tee) section 216 recombines the two orthogonal components for the lowest frequency signal. Magic tee (hybrid tee) 216 is a four port, 180 degree hybrid splitter, realized in a waveguide. The signal then goes to receiver electronics through LF RHCP port 301 or LF LHCP port 204. For linear polarization, polarizer 214 and magic tee (hybrid tee) 216 are not needed. In this case, vertical and horizontal polarization ports would be placed directly after each LF filter 212, extended to the sidewall of the split block. Dummy ports 213 are connected to common junction 208 when a symmetrical structure is needed to eliminate unwanted modes and to help axial ratio. Junction 224 moves higher frequency signals to HF filtering section 228, and then to HF 90° polarizer 222. Dummy ports 218 are also connected to the junction and are required when a symmetrical structure is needed to eliminate unwanted modes and to help axial ratio. The two orthogonal components of the HF signal are recombined by magic tee (hybrid tee) 226 and then exit out through HF RHCP port 302 or HF LHCP port 205. For linear polarization, polarizer 222 and magic tee (hybrid tee) 226 are not needed. In this case, vertical and horizontal polarization ports would be placed directly after HF junction 224, extended to the sidewall of the split block. Multi-frequency waveguide internal structure 210 has axial length L2.

As can be seen on FIG. 1A, the prior art invention provides a compact subassembly without flanges or mounting bolts that add to the complexity of earlier prior art waveguide feeds. This reduces the cost of manufacture and assembly, and also reduces the physical size of the waveguide feed. Multi-frequency waveguide internal structure 210 can easily be sectioned in a three split block configuration for ease of manufacture, which is described below. It should be noted that a dual band four-port waveguide feed is described but this layout can easily be expanded to accommodate additional frequency bands and associated waveguide ports.

FIGS. 2A, 2B show the left side frontal perspective views of the an embodiment of the present invention, which is a split block, three section compact assembly comprising all of the functions as previously described in FIG. 1A above. Compact multi-frequency feed 200 is shown with a layout in a three split block structural configuration. Split block sections include center block 202, which is between frontal block 203 and rear block 201. Shown are horn input/output area 207, LF LHCP port 204 and HF LHCP port 205. FIG. 5B is the identical perspective view as shown in FIG. 5A and additionally shows multi-frequency waveguide internal structure 210 (ref. FIG. 1A).

From FIGS. 2A and 2B it can be seen that the blocks are split about the zero current line for each of the waveguide structures in order to prevent degradation in electrical performance. The prior art as well as the present invention could also comprise multiple central blocks as necessary to obtain the desired number of frequency bands for the waveguide feed.

FIG. 3A is an enlarged right side frontal perspective view of the compact multi-frequency feed 200 and its three blocks; center block 202, frontal block 203, and rear block 201 of an embodiment of the prior invention. Also shown is LF LHCP port 204 and horn input junction 207. Inner sections will be described below in FIGS. 4A, 4B.

FIGS. 4A, 4B show the front and the rear views of the center block 202 of the compact multi-frequency feed 200. The front face of center block 202 (FIG. 4A) will be attached to the rear face of frontal block 203 and the rear face of center block 202 will be attached to the front face of rear block 201.

FIG. 4A shows HF filtering section 228 that allows only higher frequency signals to propagate to HF junction 224. Shown are LF LHCP port 204B, LF magic tee (hybrid tee) 216B, LF polarizers 214B, first common junction 208B, LF low pass filters 212B, and dummy ports 2138.

FIG. 4B is a detailed view of the rear of center block 202 with the internal recesses made into the material. HF junction 224A is connected to waveguide polarizer 222A. Waveguide polarizer 222A can be any device that creates a 90° phase delay between the two liner signals traveling in the two orthogonal paths. If the signal is linearly polarized the vertical and horizontal polarization ports would be placed directly after the HF junction 224A, and then extended to the sidewall of the split block. In this layer like the last, dummy port sections 218A are required when a symmetrical structure is required to eliminate unwanted modes and to help axial ratio. The RHCP signal from the lower frequency band travels through LF RHCP port 301A to its final destination in LF RHCP port 301. Shown is HF LHCP port 205A and hybrid tee 226A.

What is needed in the art is a feed network with close to the prior art efficiencies, but with a higher density packaging capability.

The present invention in various embodiments provides an efficient layout of waveguide components, compared to prior art, for multi-frequency band antenna feeds. It uses folded (also called curved or bent) elements to greatly reduce the center point distance in array packaging embodiments. It allows for compaction of components, maintains good electrical performance, is mechanically robust, eliminates flange connections between components, and is very cost effective to produce in small or large quantities. It can be applied to waveguide components with circular, rectangular, square, elliptical, co-axial, or any cross sections that can be created by making recesses in the split block.

The present invention allows waveguide components that can be machined in a split block configuration. Recesses are created in two pieces of material to produce the waveguide components. The components are formed after assembly of each respective split block. It eliminates the need for flanges between different components. Assembly of the blocks can be done by any method that can effectively hold the blocks together such as bolts, brazing, soldering, and adhesive bonding. Various layouts can be realized using any number of fabrication methods, such as brazing, electroforming, and machining. The apparatus and method of the present invention would reduce size by a factor of about two or more, especially in the dimension of width compared to FIG. 4A length. For example, a multi-frequency waveguide in the range of the Ka-band (18-31 GHz), would typically be about 4" depth×4.5" width by 8" long in prior art, whereas it has been demonstrated that the present invention, in the same frequency range, would reduce the size to about one inch in diameter. Typical split block sections are in a range of about 2" by 2.5" with a depth of about 0.4" to about 1.2". The significant reduction in axial length is a major advantage of the prior art invention shown in FIGS. 1-4B, especially in packaging waveguides in small compartments aboard satellites, aircraft etc. The reduction in diameter size in the present invention by folding central elements and eliminating dummy ports provides enormous advances in high density array packaging. This process is very cost effective and significantly reduces the size of multi-frequency band antenna feeds. The present invention can be applied to waveguide components with circular, rectangular, square, elliptical, co-axial, or any cross sections that can be created by making recesses in the split block. Split block fabrication techniques allow very cost effective manufacturing both during fabrication and assembly regardless of quantities involved.

Split block manufacturing and assembly is used to create the unique structures used in multi-frequency band antenna feeds. For a dual frequency band feed only three blocks are required. A tri-band feed requires an assembly of four blocks. This technique can be used for as many unique frequency bands as are desired by the application for which they are intended for use.

Elimination of the need for flanges in the prior art between the different components required by the feed eliminates the risk of electrical performance degradation due to flange misalignments and imperfections.

Created blocks are joined at the zero current line of the components, which practically eliminates electrical performance degradation that may arise due to misalignment between two adjacent blocks. There is no limit to the frequency bands that can be applied to it as long as a practical method of fabrication is available. The layout provides the ability to use standard tracking systems.

SUMMARY OF THE INVENTION

Aerospace and other types of components may be configured for compactness and simplicity to build utilizing one sided folded waveguide filters, with an asymmetric coupler for CP operation. Compactness and simplicity to build may be realized by reconfiguration of spaces and elements to utilize such otherwise available spaces, for example by folding various components, such as filters or the like, in suitable configurations. This compactness may be useful in array structures.

Aerospace components, such as microwave antenna feed networks and the like, may be configured in numerous different ways. For aerospace applications, configuring networks as compactly as possible may be desirable to keep weight to a minimum, maximize use of valuable and often limited space and help with array configurations. One way to minimize the overall envelope of a component such as an antenna feed may be to use traditional filters with bends in the filters. Current designs have not used these bends for in packaging waveguide filters. Network components due to issues such as difficulty in achieving a symmetric layout which may ensure optimal performance, manufacturing constraints, or difficulty Aerospace components may be manufactured in many different ways. To reduce cost and improve time to manufacture, split block machining is preferred. Current designs may not have used split block machining due to the need for symmetry and the need to minimize joints to minimize impact on RF performance.

The present inventive technology includes a variety of aspects, which may be combined or configured in different ways to achieve various uses. The following descriptions are provided to list elements and describe some of the embodiments of the present inventive technology. These elements are listed with initial embodiments, however it should be understood that they may be combined in any manner and in any number to create additional embodiments. The variously described examples and preferred embodiments should not be construed to limit the present inventive technology to only the explicitly described systems, techniques, and applications. Further, this description should be understood to support and encompass descriptions and claims of all the various embodiments, systems, techniques, methods, devices, and applications with any number of the disclosed elements, with each element alone, and also with any and all various permutations and combinations of all elements in this or any subsequent application.

Although various concepts herein may be explained in the context of microwave antenna feeds, such explanations should be considered illustrative and should not be construed to limit the broad inventive principles underlying these concepts, nor should the scope of the inventive technology be understood to be limited only to microwave antenna feeds specifically or aerospace components generally.

The present inventive technology may involve the concept of configuring aerospace or other components, such as a microwave network, to utilize a one sided folded waveguide filter, and with an asymmetric coupler for CP operation. A microwave network may be configured in any manner to perform the functions necessary for a specific application, such as circular polarization, single or multiple operating frequency bands or any combinations of number of frequency bands and or polarizations. Embodiments also may involve configuring aspects of the system such as compactness, thermal efficiency, and easy manufacturing.

Other aspects of this invention will appear from the following description and appended claims, reference being made to the accompanying drawings forming a part of this specification wherein like reference characters designate corresponding parts in the several views.

BRIEF DESCRIPTION OF THE DRAWINGS

Although the present invention has been described with reference to preferred embodiments, numerous modifications and variations can be made and still the result will come within the scope of the invention. No limitation with respect to the specific embodiments disclosed herein is intended or should be inferred.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF DRAWINGS

The present invention provides an efficient selection and layout of waveguide components for multi-frequency band antenna feeds. Optimization of layout eliminates components otherwise needed in prior art configurations. The layout of components in a systematic fashion starting from the horn input area and progressing from the lowest frequency to the next highest frequency, and so forth, results in an optimization of layout, and the number of components required. This process leads to the ability to manufacture an apparatus such that components can be machined (or otherwise manufactured) in a split block configuration or produced by other manufacturing means including brazing, electroforming, machining, etc.

The optimization of layout is most effective and is able to be totally produced in a split-block construction, in which the waveguide components are formed in the recesses split about the zero current line. This layout results in a very compact feed, which has excellent electrical characteristics, is mechanically robust, eliminates flange connections between components, and is very cost effective to produce. An embodiment of the present invention will be described herein with a dual frequency, four port layout.

Figure 1A:
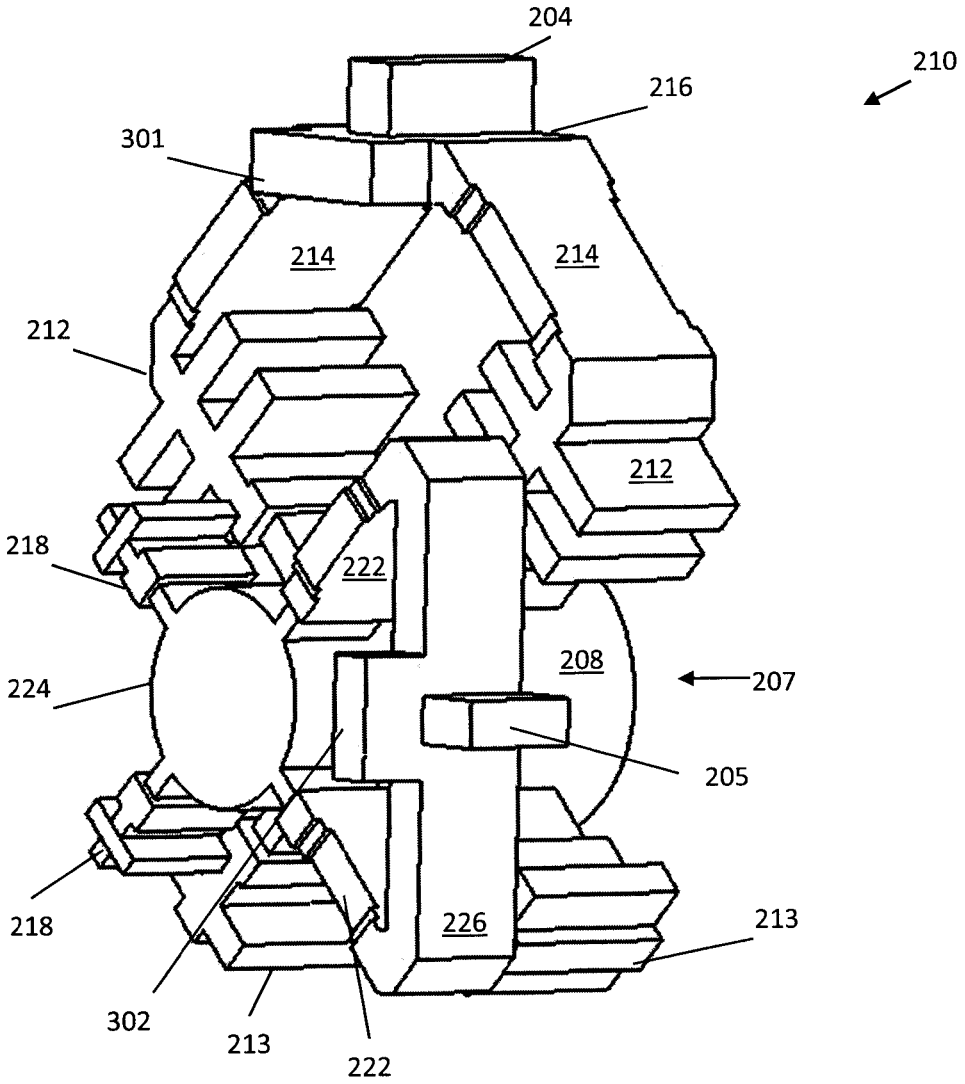
FIG. 1A (Prior Art)
FIG. 1A (prior art) is a solid rear left side perspective view of the assembly of the multi-frequency waveguide internal structure for an embodiment of the present invention.
Figure 1B:
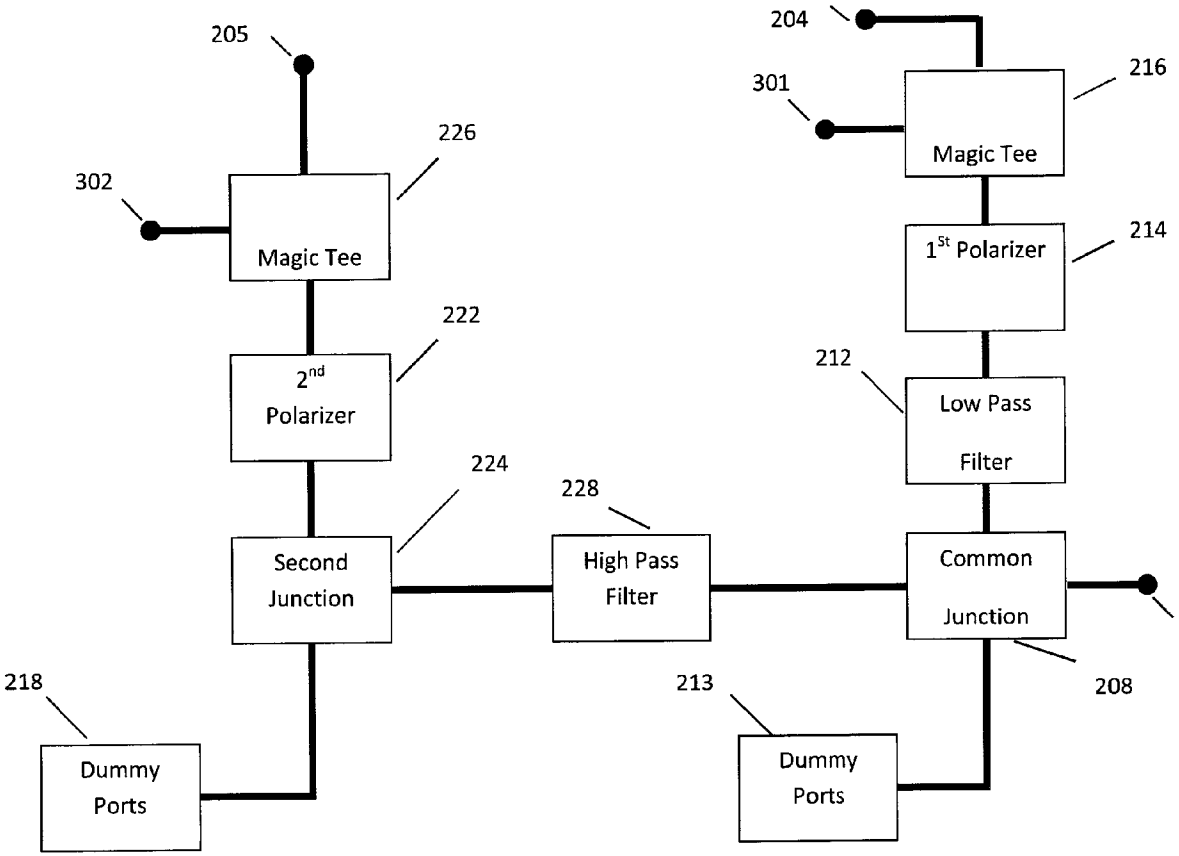
FIG. 1B (Prior Art)
FIG. 1B (prior art) is a simplified block diagram of the assembly of the multi-frequency waveguide internal structure of FIG. 4A.
Figure 2B:
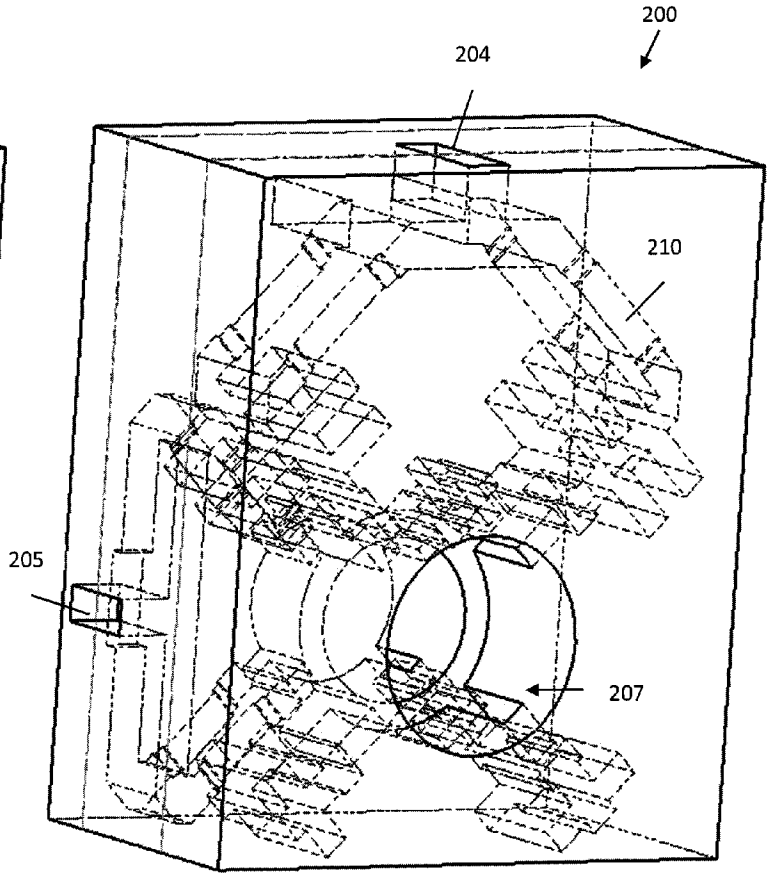
FIG. 2B (Prior Art)
FIG. 2B (prior art) is a left side frontal perspective view also showing the interior of the antenna feed assembly of an embodiment of the present invention as viewed from the horn side.
Figure 2A:
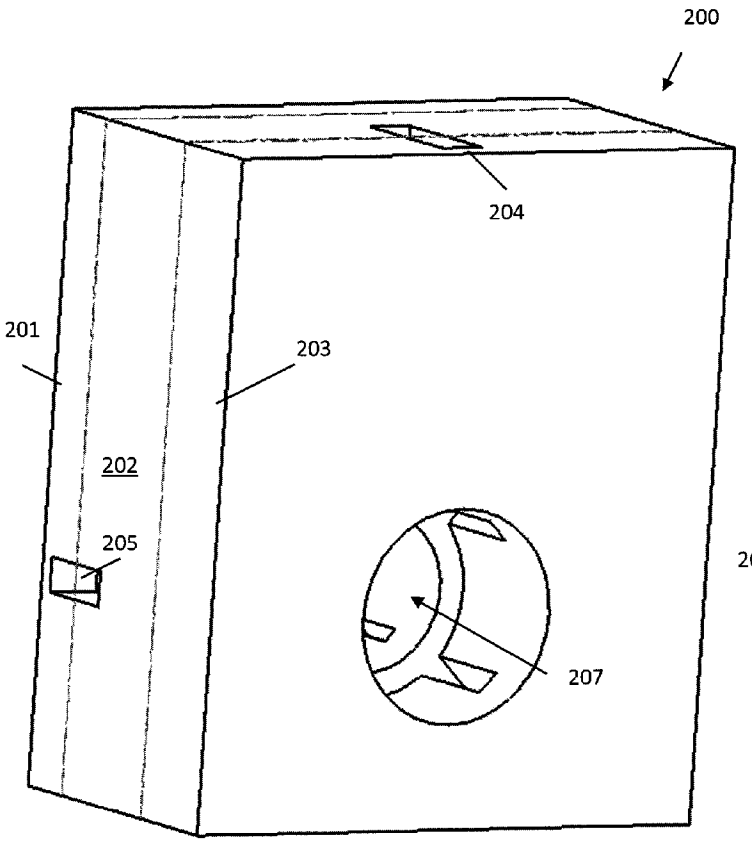
FIG. 2A (Prior Art)
FIG. 2A (prior art) is a left side frontal perspective view of the exterior portions of the antenna feed assembly of an embodiment of present invention as viewed from the horn side.
Figure 3A:
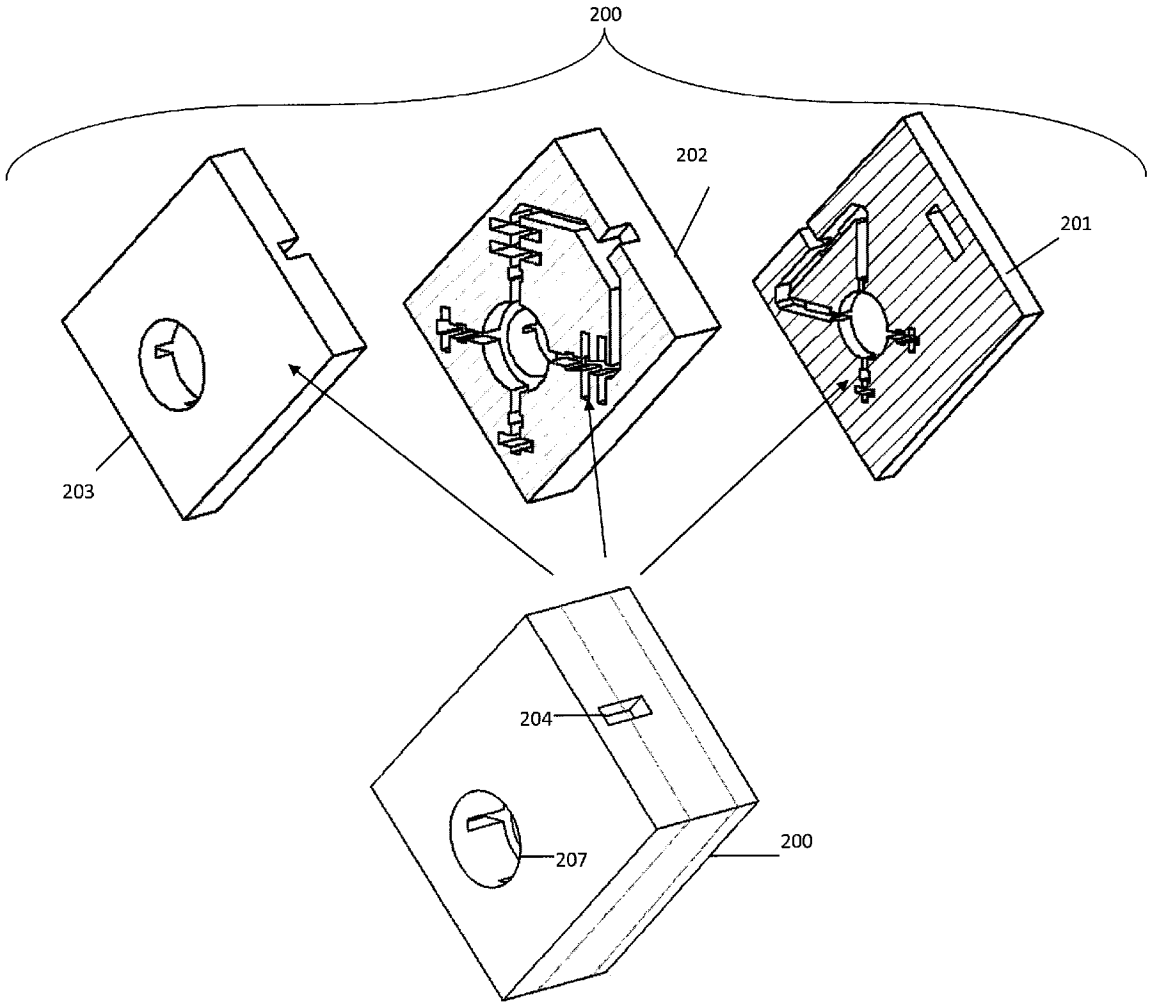
FIG. 3A (Prior Art)
FIG. 3A (prior art) is an exploded right side frontal perspective view of the compact multi-frequency feed and its three blocks of an embodiment of the present invention.
Figure 4B:
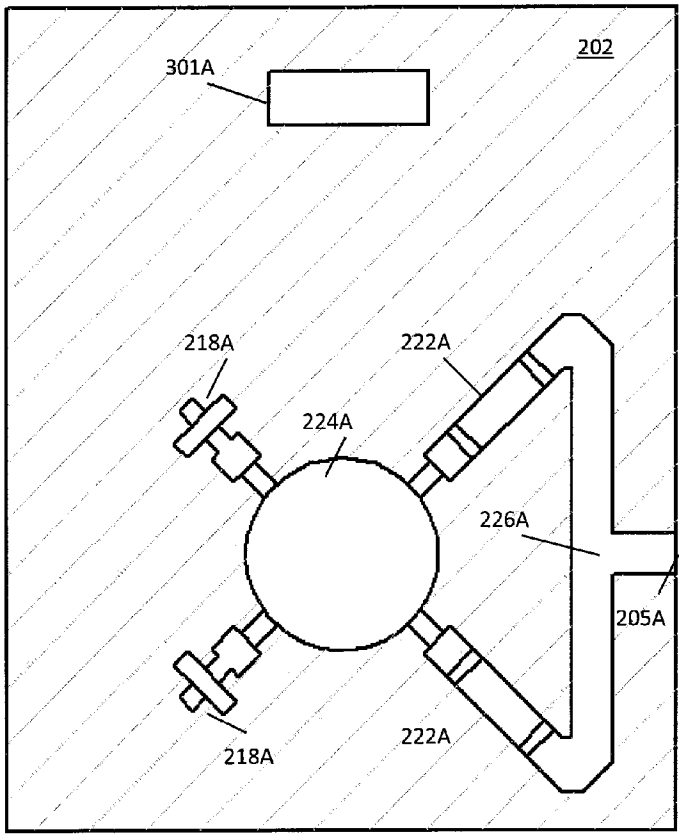
FIG. 4B (Prior Art)
FIG. 4B (prior art) shows the rear side view of the center block of the compact multi-frequency feed.
Figure 4A:
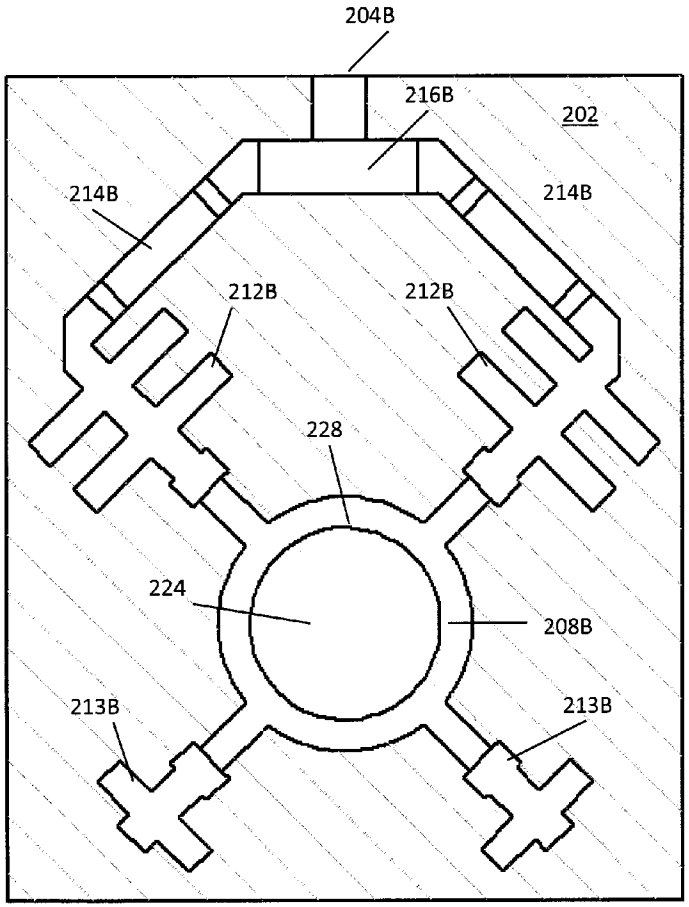
FIG. 4A (Prior Art)
FIG. 4A (prior art) shows the front side view of the center block of the compact multi-frequency feed.
Figure 5:
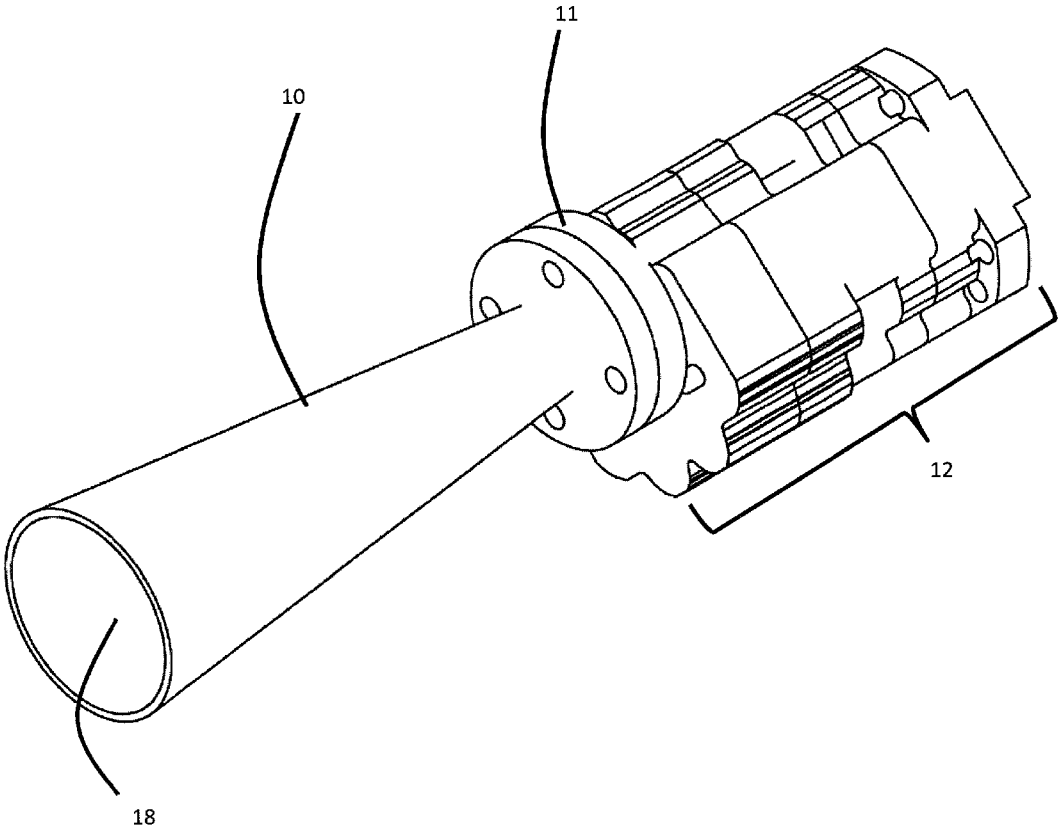
FIG. 5 is a right side perspective view of the preferred embodiment waveguide.
Figure 6:
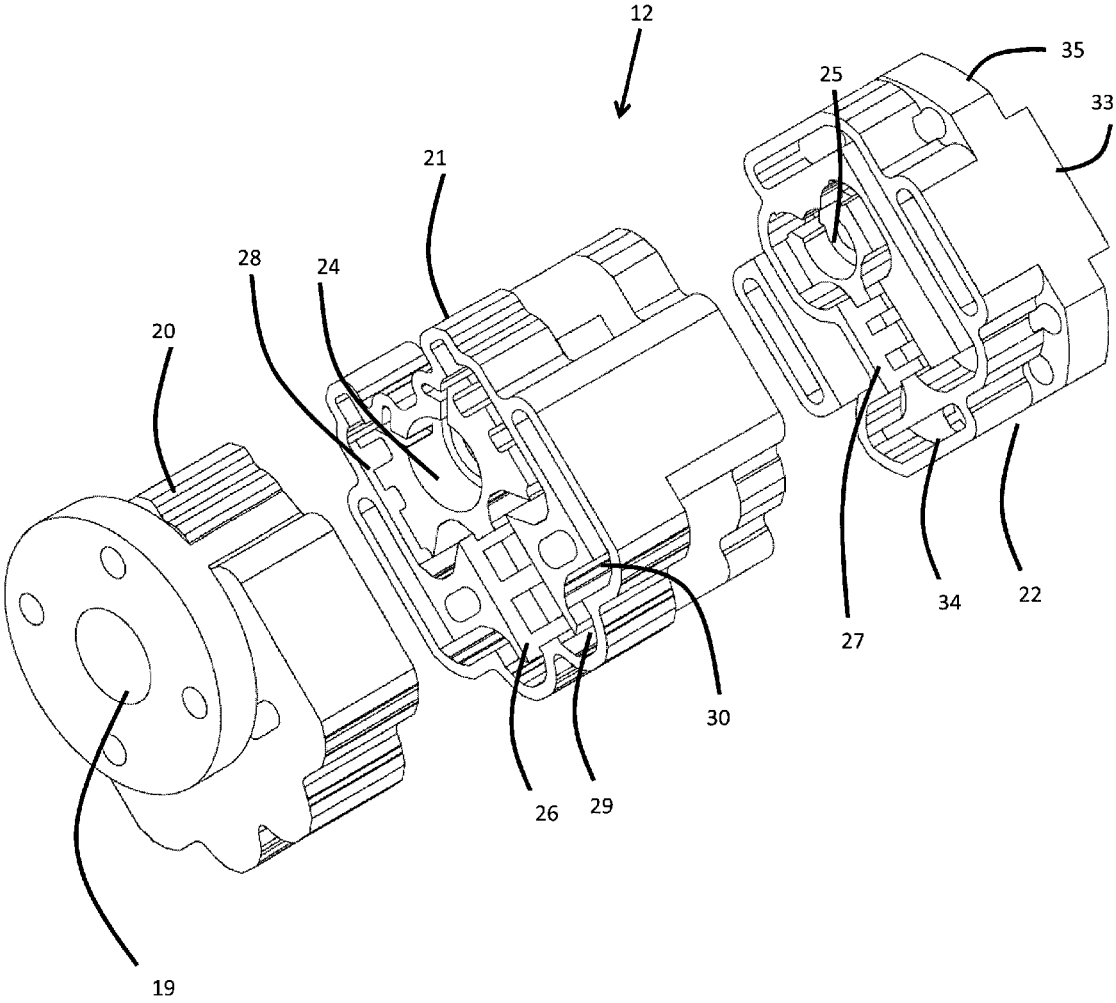
FIG. 6 is an exploded view of the FIG. 5 embodiment.
Figure 7:
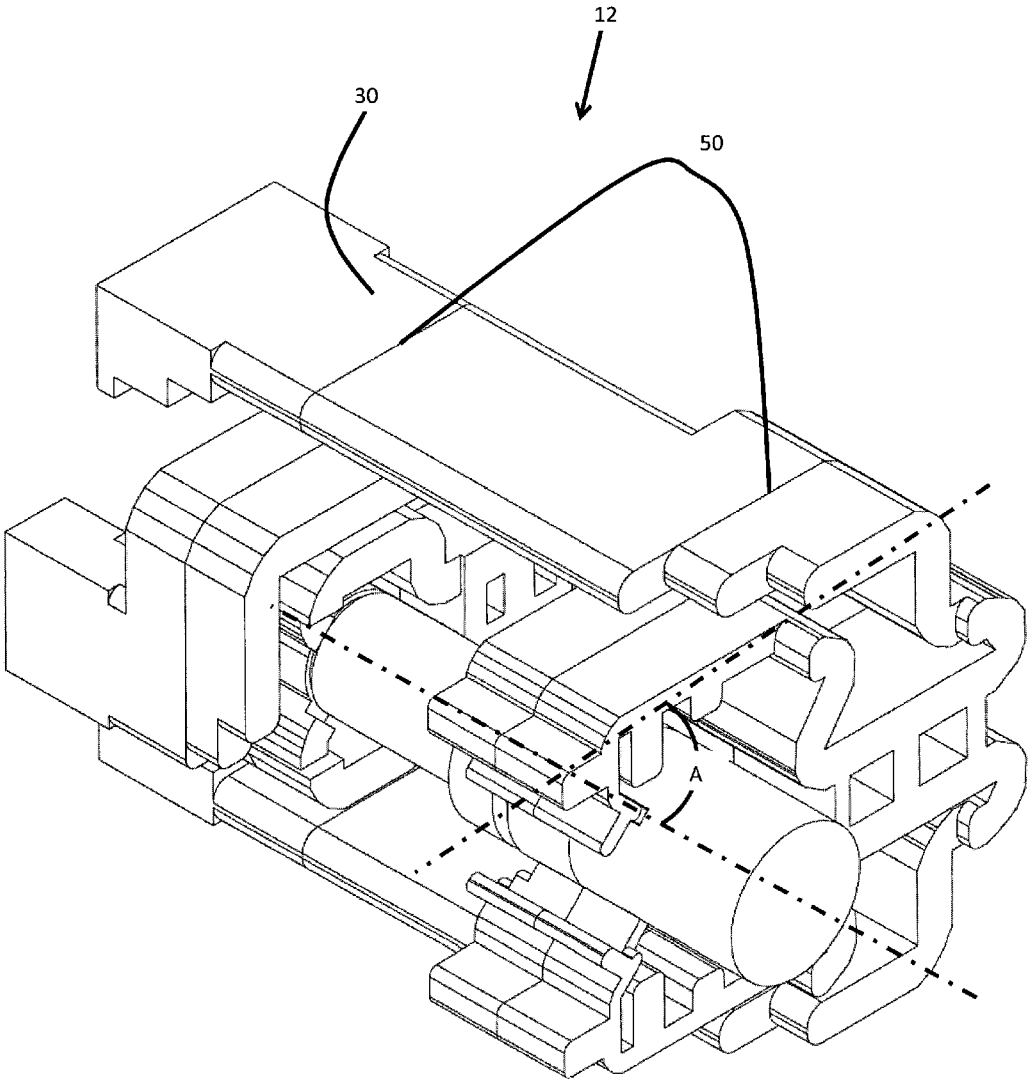
FIG. 7 is a left side perspective view of the FIG. 5 embodiment.
Figure 8:
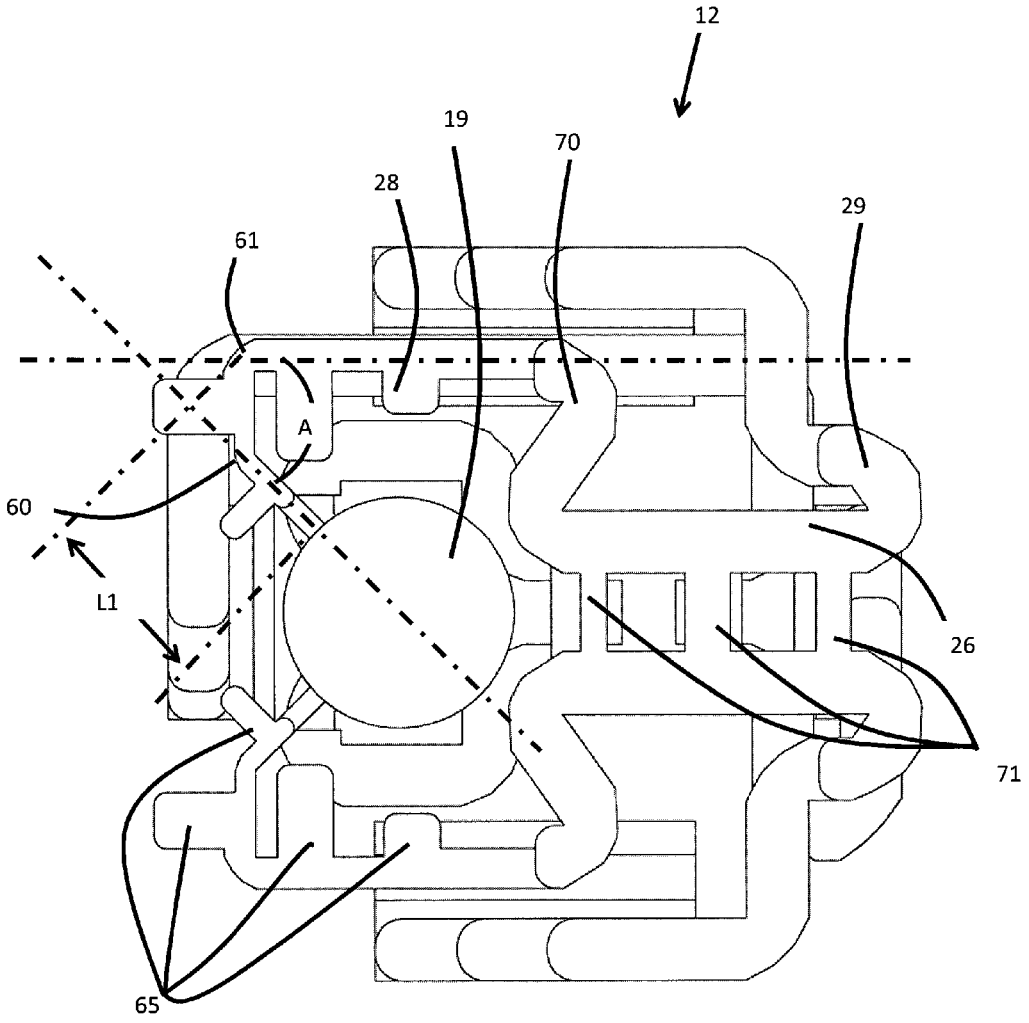
FIG. 8 is a front elevation view of the FIG. 5 embodiment.
Figure 9:
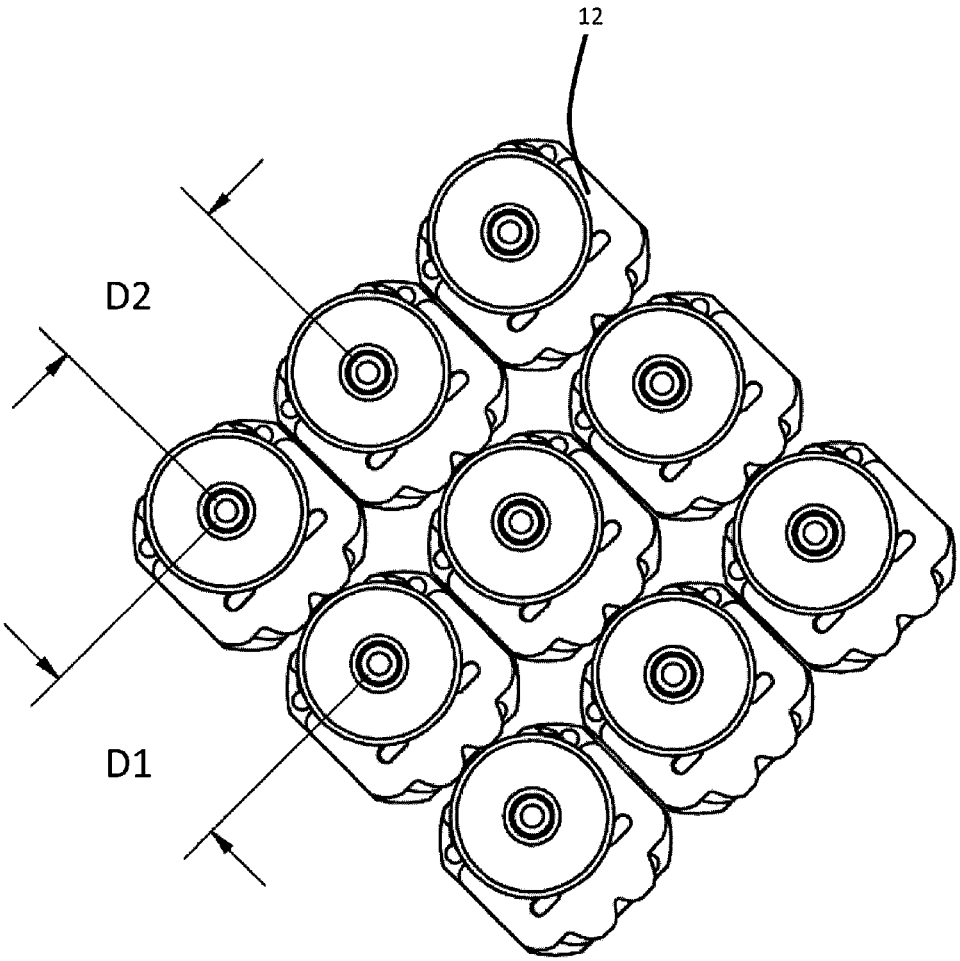
FIG. 9 is a front perspective view of an array of waveguides.
Figure 11:
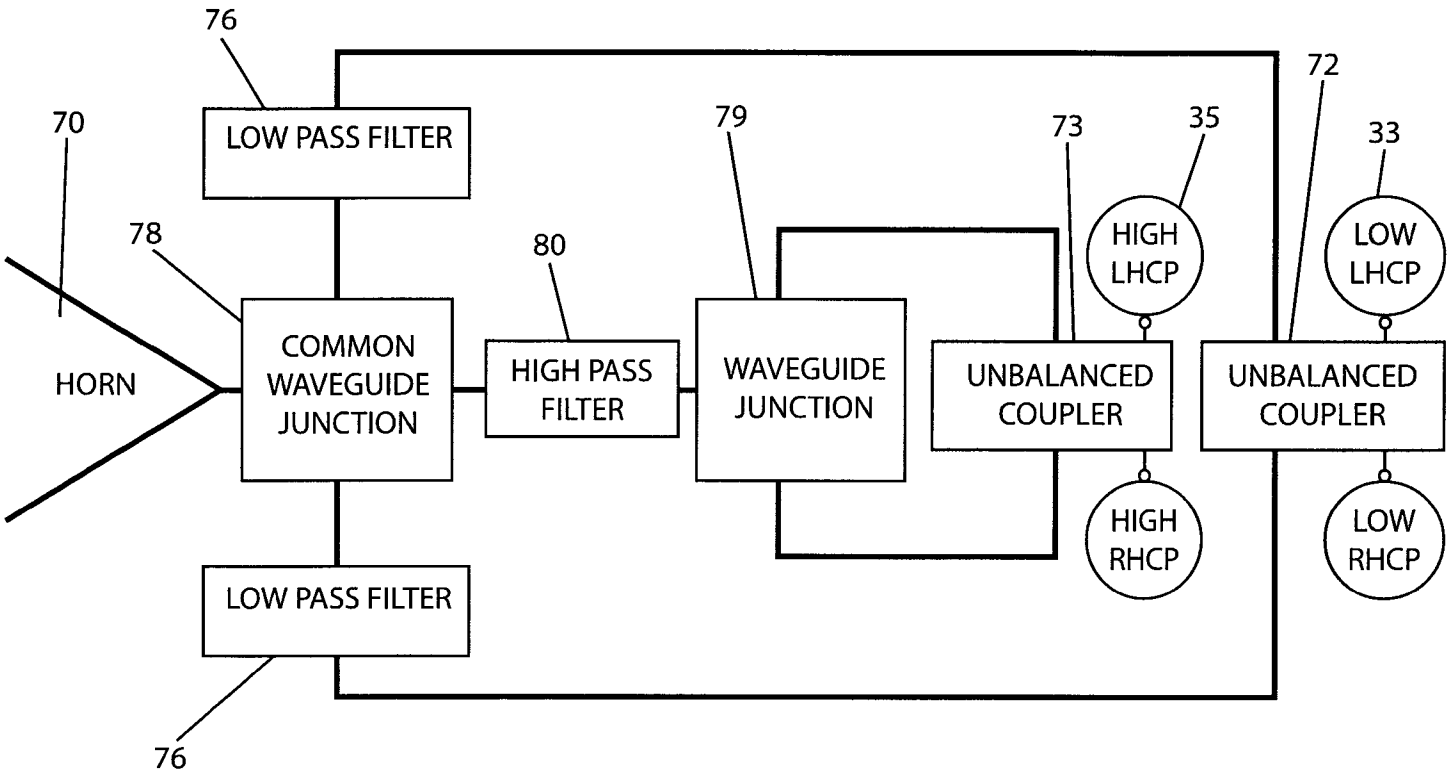
FIG. 11 is a simplified block diagram of the waveguide shown in FIG. 5.

FIG. 5 shows a complete microwave antenna feed in one exemplary embodiment, including a horn 10 and network 12. The horn 10 includes an aperture 18 at one end. The horn 10 may be separable from the network at flange interface 11. FIG. 6 shows an exploded view of the network 12, showing internal cavities. FIG. 7 shows a detailed internal cavity view of the network 12 shown in FIG. 5 in one exemplary embodiment. FIG. 8 is an alternative view of the same network shown in FIG. 7 in one exemplary embodiment, viewed from the horn interface. FIG. 9 shows one exemplary embodiment of an array configuration. FIG. 11 is a schematic diagram of the complete microwave antenna feed shown in FIG. 5 in one exemplary embodiment.

The function of the feed components shown in FIG. 11 is described below for one exemplary embodiment:

- A horn 70 may radiate signals into and out of the network of subcomponents
- An unbalanced coupler 72 may convert linear polarization to circular polarization for the low frequency
- Two low pass filters 76 may reject one or more higher frequency bands in a lower frequency band path
- An asymmetric 4 port waveguide junction 78 may combine the two orthogonal 90 degree phase shifted signals into circular polarization. A circular waveguide interface may be provided to the horn
- A high frequency band filter 80 may reject lower frequency bands in the higher frequency band path
- An asymmetric 3 port waveguide junction 79 may combine the two orthogonal 90 degree phase shifted signals into circular polarization. A circular waveguide interface may be provided to the high pass 80 filter or to the 4 port waveguide junction 78.
- An unbalanced coupler 73 may convert linear polarization to circular polarization for the high frequency FIG. 5 shows one embodiment in which one sided folded filters with asymmetric couplers are used, which may provide an extremely compact layout. The layout shows the two major components for the feed. The horn 10, and the network 12. The network 12 in this embodiment is made up of three components.

FIG. 6, shows one embodiment in which the network from FIG. 5 is manufactured in three parts, first 20, second 21, and third 22. The horn input port 19, is where the horn connects to the network. The internal cavity is shown for the low frequency junction 24, this is connected to the one sided low pass waveguide filter 28. The one sided low pass waveguide filter 28, connects to the low frequency asymmetric coupler 26. A network of bends 29 connects to a waveguide pass through 30, which goes to the waveguide interface 33. The internal cavity is shown for the high frequency junction 25, this is connected, bends 36, then to the low frequency asymmetric coupler 27. The coupler is connected with bends 37*a* and 37*b* to a pass through 34 which toes to the waveguide interface 35.

FIG. 7, shows the internal cavity of the feed. Split lines 50, are shown where the blocks are split as shown in FIG. 6.

FIG. 8 is a view from the horn input port 19. Angle A can range from about 20 degrees to about 175 degrees. The range of length L1 can be from about 0.1 to about 1 wavelengths. The feed junction 24, is connected to the one sided low pass folded waveguide filter 28. The low pass folded waveguide filter 28, has bend 60, and bend 61, which could be of any angle to fold the filter into a compact shape. One filter element is bent to an angle A, thereby enabling a high density packaging of the microwave feed network; and wherein a plurality of single sided corrugations are located along the bent filter element. The low pass folded waveguide filter 28, has single sided corrugations 65 which may be on either side of the filter, enabling a very compact layout. Further bends 70 allow the unbalanced coupler 26, to be packed tightly to the asymmetric low frequency junction 24. The coupler slots 71 create an electrical unbalance to compensate for the asymmetric junction 24. The output of the unbalanced coupler 26, goes to bends 29, which tightly fold around to the waveguide pass through 30. These bends 29, could be of any angle that helps to insure a compact layout.

FIG. 9 shows an embodiment of the feed 12, where they are arranged into an array. The compact feed 12, allows for very tight array spacing, which may improve satellite performance. The center point to center point distances D1, D2 can range from about 1.3 inch to about 2 inch (wavelengths being about one to about ten).

Figure 10:
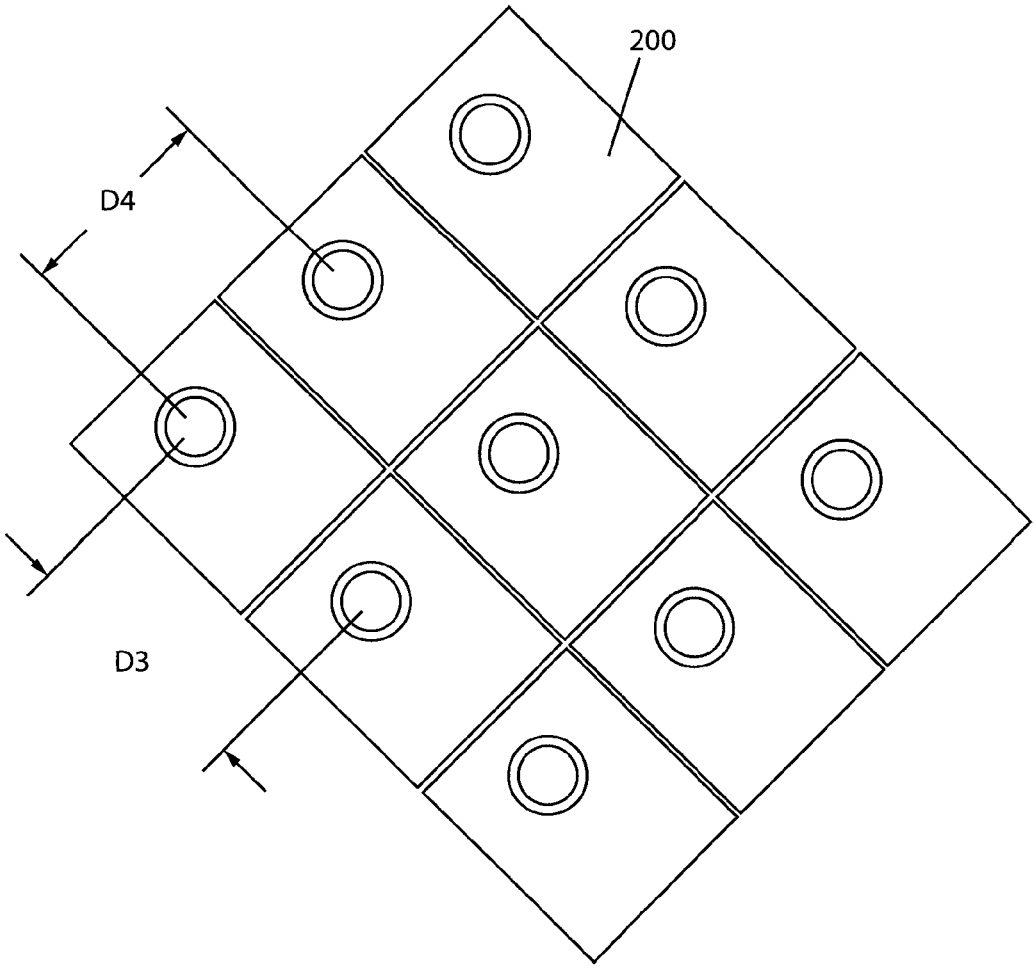
FIG. 10 (PRIOR ART)
FIG. 10 (prior art) is a front perspective view of array of prior art waveguides.

FIG. 10 shows prior art waveguide 20 from the '427 patent and larger point to point dimensions D3, D4 could be from about 4 to about 10 wavelengths.

Naturally, the configuration and space utilization principles discussed herein should be understood to be illustrative in nature and should not be construed to be limited only to the specific network embodiments described, but rather should be understood to encompass any configuration and space utilization principles consistent with the inventive principles discussed herein.

The components or subcomponents that may form the inventive technology discussed herein may be manufactured using any suitable manufacturing method, including electroforming, brazing, 3D printing or machining, and may be made of any suitable material or combinations of materials. Furthermore, the microwave antenna feed application may be used for any electromagnetic wave frequency band within the microwave band or any other frequency band or combinations of extended and or narrow frequency bands.

As can be easily understood from the foregoing, the basic concepts of the present inventive technology may be embodied in a variety of ways. It involves both compact configuration techniques as well as devices to accomplish the appropriate compact configuration. In this application, the compact configuration techniques are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this provisional application is intended to serve as a basic description. The reader should be aware that the specific discussion may not explicitly describe all embodiments possible; many alternatives are implicit. It also may not fully explain the generic nature of the inventive technology and may not explicitly show how each feature or element can actually be representative of a broader function or of a great variety of alternative or equivalent elements. Again, these are implicitly included in this disclosure. Where the inventive technology is described in device-oriented terminology, each element of the device implicitly performs a function. Apparatus claims may not only be included for the device described, but also method or process claims may be included to address the functions the inventive technology and each element performs. Neither the description nor the terminology is intended to limit the scope of the claims that will be included in any subsequent patent application.

It should also be understood that a variety of changes may be made without departing from the essence of the inventive technology. Such changes are also implicitly included in the description. They still fall within the scope of this inventive technology. A broad disclosure encompassing both the explicit embodiment(s) shown, the great variety of implicit alternative embodiments, and the broad methods or processes and the like are encompassed by this disclosure and may be relied upon when drafting the claims for any subsequent patent application. It should be understood that such language changes and broader or more detailed claiming may be accomplished at a later date (such as by any required deadline) or in the event the applicant subsequently seeks a patent filing based on this filing. With this understanding, the reader should be aware that this disclosure is to be understood to support any subsequently filed patent application that may seek examination of as broad a base of claims as deemed within the applicant's right and may be designed to yield a patent covering numerous aspects of the inventive technology both independently and as an overall system.

Further, each of the various elements of the inventive technology and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the inventive technology, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this inventive technology is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of a "fold" should be understood to encompass disclosure of the act of "folding"—whether explicitly discussed or not—and, conversely, were there effectively disclosure of the act of "folding", such a disclosure should be understood to encompass disclosure of a "fold" and even a "means for folding" Such changes and alternative terms including the terms "curved" and "bent" are to be understood to be explicitly included in the description. Further, each such means (whether explicitly so described or not) should be understood as encompassing all elements that can perform the given function, and all descriptions of elements that perform a described function should be understood as a non-limiting example of means for performing that function.

Any patents, publications, or other references mentioned in this application for patent are hereby incorporated by reference. Any priority case(s) claimed by this application is hereby appended and hereby incorporated by reference. In addition, as to each term used it should be understood that unless its utilization in this application is inconsistent with a broadly supporting interpretation, common dictionary definitions should be understood as incorporated for each term and all definitions, alternative terms, and synonyms such as contained in the Random House Webster's Unabridged Dictionary, second edition are hereby incorporated by reference. Finally, all references listed in the list of References To Be Incorporated By Reference In Accordance With The Provisional Patent Application or other information statement filed with the application are hereby appended and hereby incorporated by reference, however, as to each of the above, to the extent that such information or statements incorporated by reference might be considered inconsistent with the patenting of this/these invention(s) such statements are expressly not to be considered as made by the applicant(s).

Thus, the applicant(s) should be understood to have support to claim and make a statement of invention to at least: i) each of the compact configuration devices as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the subsequent application are considered as made to avoid such prior art, such reasons may be eliminated by later presented claims or the like. Both the examiner and any person otherwise interested in existing or later potential coverage, or considering if there has at any time been any possibility of an indication of disclaimer or surrender of potential coverage, should be aware that no such surrender or disclaimer is ever intended or ever exists in this or any subsequent application. Limitations such as arose in *Hakim* v. *Cannon Avent Group, PLC,* 479 F.3d 1313 (Fed. Cir 2007), or the like are expressly not intended in this or any subsequent related matter. In addition, support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible. The use of the phrase, "or any other claim" is used to provide support for any claim to be dependent on any other claim, such as another dependent claim, another independent claim, a previously listed claim, a subsequently listed claim, and the like. As one clarifying example, if a claim were dependent "on claim 20 or any other claim" or the like, it could be re-drafted as dependent on claim 1, claim 15, or even claim 25 (if such were to exist) if desired and still fall with the disclosure. It should be understood that this phrase also provides support for any combination of elements in the claims and even incorporates any desired proper antecedent basis for certain claim combinations such as with combinations of method, apparatus, process, and the like claims.

Finally, any claims set forth at any time are hereby incorporated by reference as part of this description of the inventive technology, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Although the present invention has been described with reference to the disclosed embodiments, numerous modifications and variations can be made and still the result will come within the scope of the invention. No limitation with respect to the specific embodiments disclosed herein is intended or should be inferred. Each apparatus embodiment described herein has numerous equivalents.

We claim:

1. A multilayered assembly forming a microwave feed network, the assembly comprising:

a first common junction means functioning to send/receive microwave signals;

the first common junction means connected to a second junction and to a low frequency modular area;

wherein the low frequency modular area comprises a low pass filter and low frequency ports;

wherein an interface between the first common junction means and the second junction functions as a high pass filter;

the second junction connected to the first common junction means and to a high frequency modular area;

wherein the high frequency modular area comprises high frequency ports;

wherein all components of the first common junction means, the second junction, the low frequency modular area, and the high frequency modular area are built in a modular split block configuration; and wherein the modular split block configuration comprises a plurality of split blocks;

wherein at least one low pass filter element is bent to an angle from about 20 degrees to about 175 degrees, thereby enabling a high density packaging of the microwave feed network; and wherein a plurality of single sided corrugations are located along the bent filter element.

2. The assembly of claim 1, wherein the plurality of single sided corrugations further comprise at least one inward facing corrugation and at least one outward facing corrugation.

3. The assembly of claim 2, wherein the inward facing corrugation has a longitudinal axis orientation at about a 90° orientation to a longitudinal axis orientation of the outward facing corrugation.

4. The assembly of claim 1 further comprising an unbalanced low frequency coupler having at least one bent non-linear segment, thereby shortening a width of the assembly.

5. The assembly of claim 4, wherein the at least one bent, non-linear segment is central to the microwave feed network assembly so as to reduce a width of the assembly.

6. The assembly of claim 5, wherein a second bend of the unbalanced coupler is located at an outbound side of the assembly so as to reduce the width of the assembly.

7. The assembly of claim 4, wherein the at least one bend is located at an outbound side of the assembly so as to reduce a width of the assembly.

8. The assembly of claim 7 further comprising a second unbalanced coupler having at least one bent, non-linear segment central to the microwave feed network assembly.

9. A multilayered assembly forming a microwave feed network, the assembly comprising:

a first common junction means functioning to send/receive microwave signals;

the first common junction means connected to a second junction and to a low frequency modular area;

wherein the low frequency modular area comprises a low pass filter and low frequency ports;

wherein an interface between the first common junction means and the second junction functions as a high pass filter;

the second junction connected to the first common junction means and to a high frequency modular area;

wherein the high frequency modular area comprises high frequency ports;

wherein all components of the first common junction means, the second junction, the low frequency modular area, and the high frequency modular area are built in a modular split block configuration; and wherein the modular split block configuration comprises a plurality of split blocks;

wherein at least one unbalanced coupler element is bent, thereby enabling a high density packaging of the microwave feed network; and wherein the bend is located central to the assembly and facing outbound so as to place a bent segment adjacent a central asymmetric junction, thereby reducing a width of the assembly.

10. The assembly of claim 9 further comprising a second bend of the unbalanced coupler located outbound of the most outbound coupler slot.

11. The assembly of claim 9 further comprising at least one filter element that is bent and comprises a plurality of single sided corrugations.

12. The assembly of claim 11, wherein the assembly further comprises a dual frequency, four port layout.

13. The assembly of claim 11, wherein the central asymmetric junction further comprises a low frequency junction.

14. The assembly of claim 13 further comprising a third layer comprising a high frequency asymmetric function having a bend located central to the assembly and facing outbound so as to place a bent segment adjacent the high frequency asymmetric junction.

15. An array of multilayered feed network modules comprising:

each module having:

a first common junction means functioning to send/receive microwave signals;

the first common junction means connected to a second junction and to a low frequency modular area;

wherein the low frequency modular area comprises a low pass filter and low frequency ports;

wherein an interface between the first common junction means and the second junction functions as a high pass filter;

the second junction connected to the first common junction means and to a high frequency modular area;

wherein the high frequency modular area comprises high frequency ports;

wherein all components of the first common junction means, the second junction, the low frequency modular area, and the high frequency modular area are built in a modular split block configuration; and wherein the modular split block configuration comprises a plurality of split blocks;

wherein at least one low pass filter element is bent to an angle from about 20 degrees to about 175 degrees, thereby enabling a high density packaging of the microwave feed network; and wherein a plurality of single sided corrugations are located along the bent filter element;

said array comprising at least two side by side adjacent modules, wherein each module is manufactured in three parts.

16. The array of claim 15, wherein a horn input port for each module is coaxial with the adjacent module, and the horn input ports are facing in a common direction.

17. The array of claim 16, wherein each module further comprises a common horizontal plane.

* * * * *